US010681943B1

(12) United States Patent
Seipmann

(10) Patent No.: US 10,681,943 B1
(45) Date of Patent: Jun. 16, 2020

(54) REFLECTOR SYSTEM

(71) Applicant: Pacific Quest International, LLC, San Jose, CA (US)

(72) Inventor: Helmut Seipmann, Burlington (CA)

(73) Assignee: Pacific Quest International, LLC, San Jose, CA (US)

( * ) Notice: Subject to any disclaimer, the term of this patent is extended or adjusted under 35 U.S.C. 154(b) by 9 days.

(21) Appl. No.: 16/212,259

(22) Filed: Dec. 6, 2018

Related U.S. Application Data

(60) Provisional application No. 62/595,692, filed on Dec. 7, 2017.

(51) Int. Cl.
*A41D 13/01* (2006.01)
*A41D 3/00* (2006.01)
*A41D 27/08* (2006.01)

(52) U.S. Cl.
CPC ..... *A41D 13/01* (2013.01); *A41D 3/00* (2013.01); *A41D 27/085* (2013.01)

(58) Field of Classification Search
CPC ..... A41D 13/01; A41D 31/32; A41D 31/325; A41D 3/00; A41D 3/02; A41D 1/02; A41D 1/04; A41D 1/06; A41D 1/08; A41D 13/0015; A41D 27/085; A41D 1/082–1/089; G08B 5/004; G02B 5/12; G02B 5/136; G02B 5/124
USPC ..... 359/516–519, 546
See application file for complete search history.

(56) References Cited

U.S. PATENT DOCUMENTS 3,381,307 A * 5/1968 Shingler ..... A41D 13/01 2/94
3,472,198 A * 10/1969 Rinecker ..... G08B 5/004 116/200
3,600,211 A * 8/1971 Ferrari ..... E01F 13/028 428/196
3,849,804 A * 11/1974 Rakow ..... A41D 13/01 359/518
4,091,766 A * 5/1978 Colliard ..... A01K 27/005 119/858
5,159,718 A * 11/1992 Moyer ..... A41D 13/01 2/102
5,169,702 A * 12/1992 Schell ..... A01K 27/006 119/858
5,570,945 A * 11/1996 Chien ..... A41D 13/01 362/103

(Continued)

FOREIGN PATENT DOCUMENTS

CH 680036 A5 * 6/1992 ..... A41D 27/10
JP 3173431 B2 * 6/2001 ..... A41D 1/084

*Primary Examiner* — Amy Vanatta
(74) *Attorney, Agent, or Firm* — Eric Karich; Karich & Associates

(57) ABSTRACT

A reflective garment has a jacket having a channel formed therein. A strap slidably engages the channel, so that the strap may slide longitudinally within the channel. Cover bands extend across the channel, and over the strap, so that the strap slides within the channel and beneath the plurality of cover bands. The strap including a front surface that includes a plurality of reflective sections that are spaced apart from one another by a non-reflective sections, such that when the strap is in a first position, each of the plurality of cover bands covers one of the reflective sections, and when the strap is in a second position, the reflective sections are each within an open windows between the cover bands.

10 Claims, 4 Drawing Sheets

(56) References Cited

U.S. PATENT DOCUMENTS

| | | | | |
|---|---|---|---|---|
| 7,048,391 | B2 * | 5/2006 | Greves | G08B 5/004 359/516 |
| 7,353,545 | B1 * | 4/2008 | Blauer | A41D 13/01 2/115 |
| 7,669,249 | B2 * | 3/2010 | Blauer | A41D 13/01 2/115 |
| 2003/0177561 | A1 * | 9/2003 | Sloot | A01K 11/00 2/16 |
| 2004/0237177 | A1 * | 12/2004 | Grilliot | A41D 13/01 2/455 |
| 2017/0258147 | A1 * | 9/2017 | Thompson | A41D 31/32 |
| 2019/0104777 | A1 * | 4/2019 | Lauf | A41D 13/01 |

* cited by examiner

REFLECTOR SYSTEM

CROSS-REFERENCE TO RELATED APPLICATIONS

This application for a utility patent claims the benefit of U.S. Provisional Application No. 62/595,692, filed Dec. 7, 2017.

BACKGROUND OF THE INVENTION

Field of the Invention

This invention relates generally to reflectors, and more particularly to a reflector system for clothing and other items that may be adjusted to have a different external appearance, e.g., to either reflect light, or not reflect light, or otherwise change appearance.

Description of Related Art

It is sometimes desirable for clothing to reflect light, such as for reasons of safety while the user is wearing the clothing at night. At other times, it may be desirable for the clothing to not reflect light. Particularly in the field of military clothing and uniforms, it may be desirable for the reflector to be altered to a non-reflective configuration, such as showing a camouflage pattern.

The prior art teaches military clothing that includes a patch that is reflective on one side, and camouflage on the other side. The patch may be attached to the clothing with a fastener (e.g., hooks and loops) with either the reflective side or the camouflage side facing outwardly, depending upon the needs of the user.

The present invention teaches a superior reflector system that provides superior reflector coverage that is easy to switch between reflective and non-reflective configurations.

SUMMARY OF THE INVENTION

The present invention teaches certain benefits in construction and use which give rise to the objectives described below.

The present invention provides a reflective garment adapted to be worn by a person. The reflective garment includes a jacket; a channel formed in the jacket, the channel having side edges that extend between a proximal end and a distal end; a strap having a first end and a second end, the strap being shaped and sized to fit into and slidably engage the channel, so that the strap may slide longitudinally within the channel between the proximal end and the distal end; a plurality of cover bands that extend across the channel, and over the strap, so that the strap slides within the channel and beneath the plurality of cover bands, the plurality of cover bands being longitudinally spaced from each other and from the proximal end and the distal end of the channel to form a plurality of open windows therebetween; the strap including a front surface that includes a plurality of reflective sections that are spaced apart from one another by a non-reflective sections; and wherein when the strap is in a first position, each of the plurality of cover bands covers one of the reflective sections, and when the strap is in a second position, the reflective sections are each within one of the open windows between the cover bands, and thereby positioned to reflect light incident thereupon.

A primary objective of the present invention is to provide a reflective garment having a reflector system having advantages not taught by the prior art.

Another objective is to provide a reflective garment that is able to be quickly and easily transitioned between a safety configuration wherein the garment is reflective, and a second configuration wherein the garment is not reflective.

A further objective is to provide a reflective system that is easy to use and inexpensive to manufacture.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above-described drawing figures illustrate the invention, a reflector system that provides superior reflector coverage that is easy to switch between reflective and non-reflective configurations. The reflector system may be incorporated into any article of clothing (e.g., jackets, pants, hats, helmets, gloves, parkas, coveralls, shoes, boots etc.), as well as other articles, such as backpacks, tool bags, luggage, etc.

Figure 1:
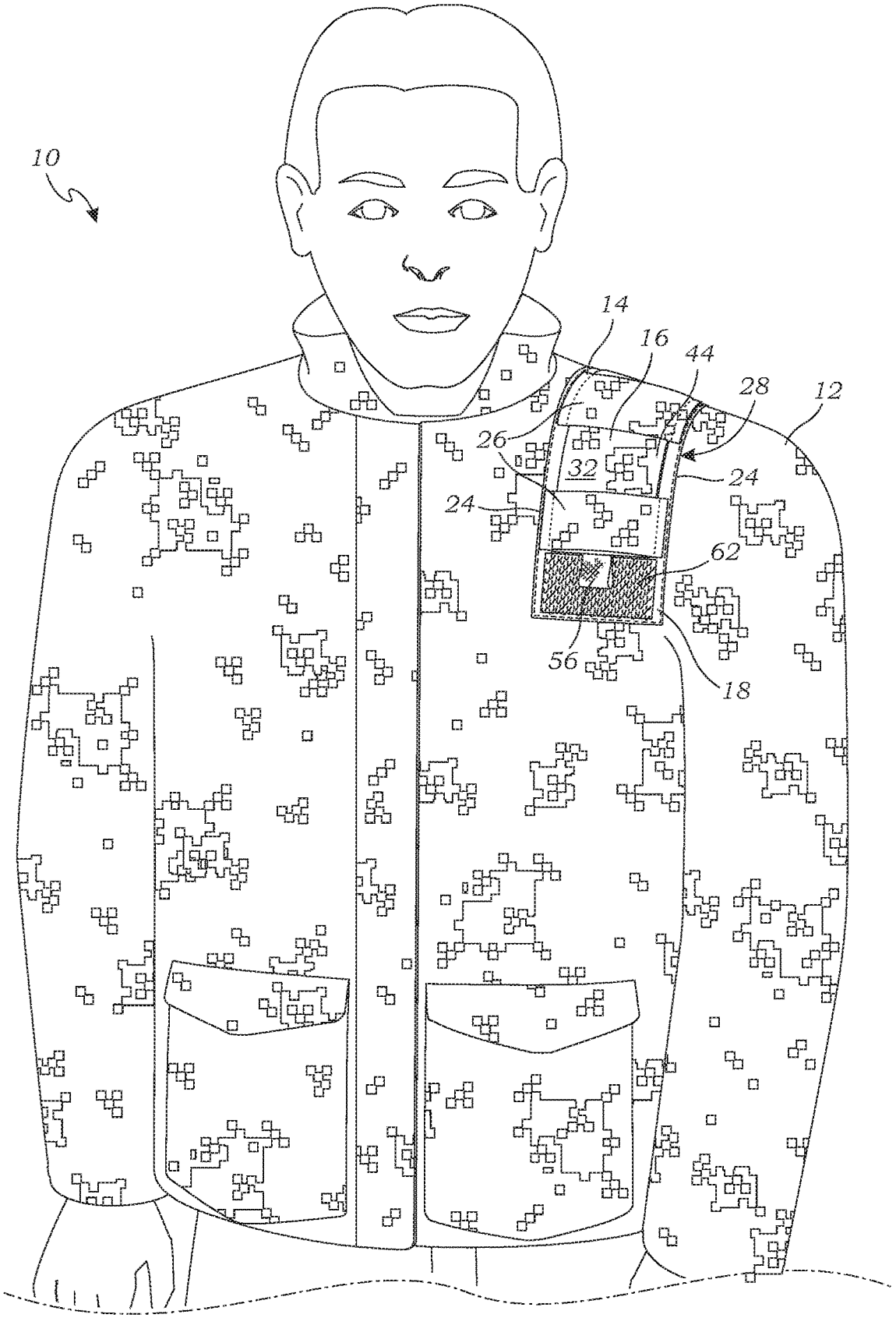
FIG. 1 is a perspective view of a jacket that includes a reflector system according to one embodiment of the present invention, illustrating the reflector system in a non-reflective configuration.
Figure 2:
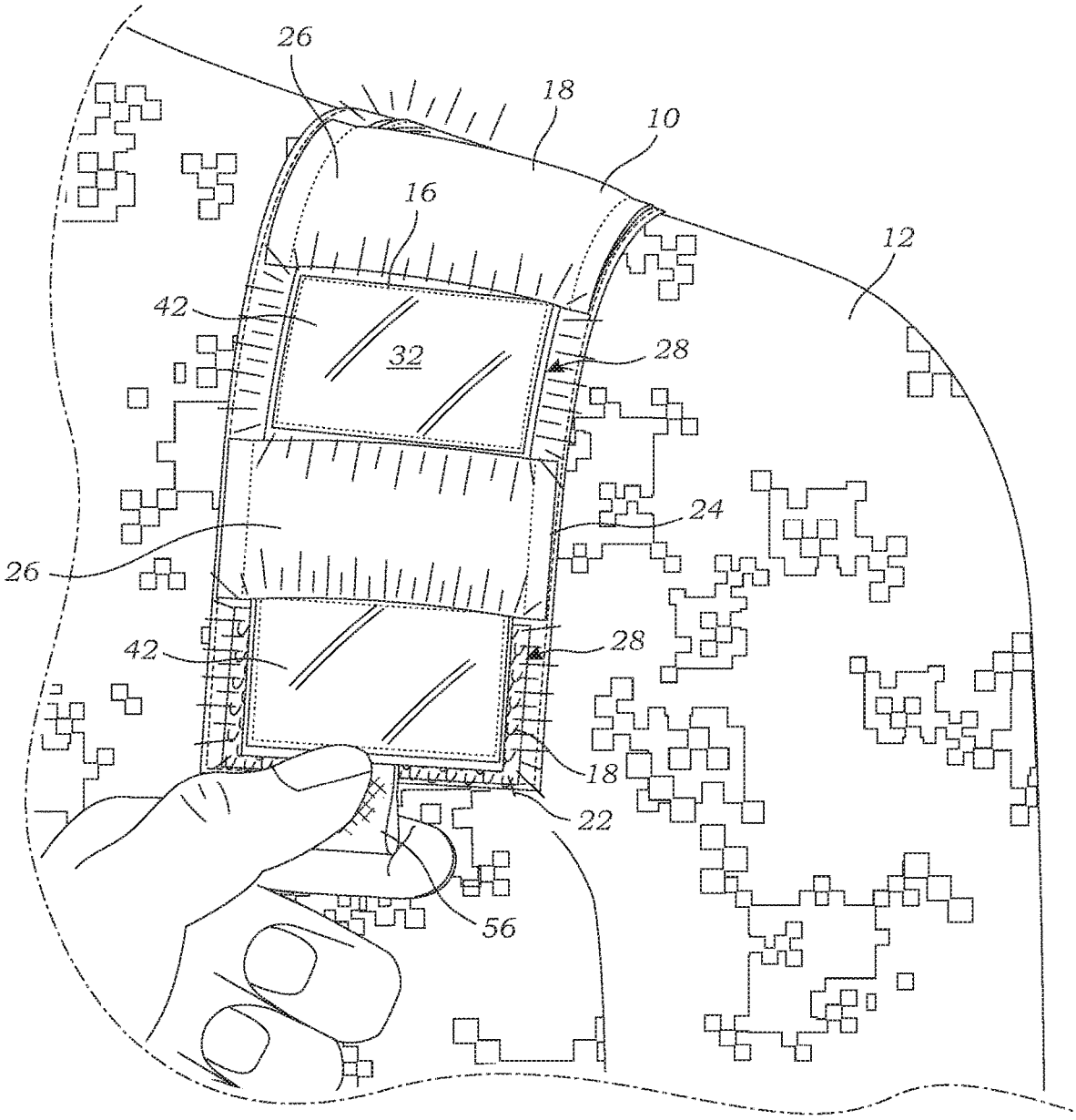
FIG. 2 is a close up perspective view of the reflector system, illustrating the reflector system being moved to a reflective configuration.
Figure 3:
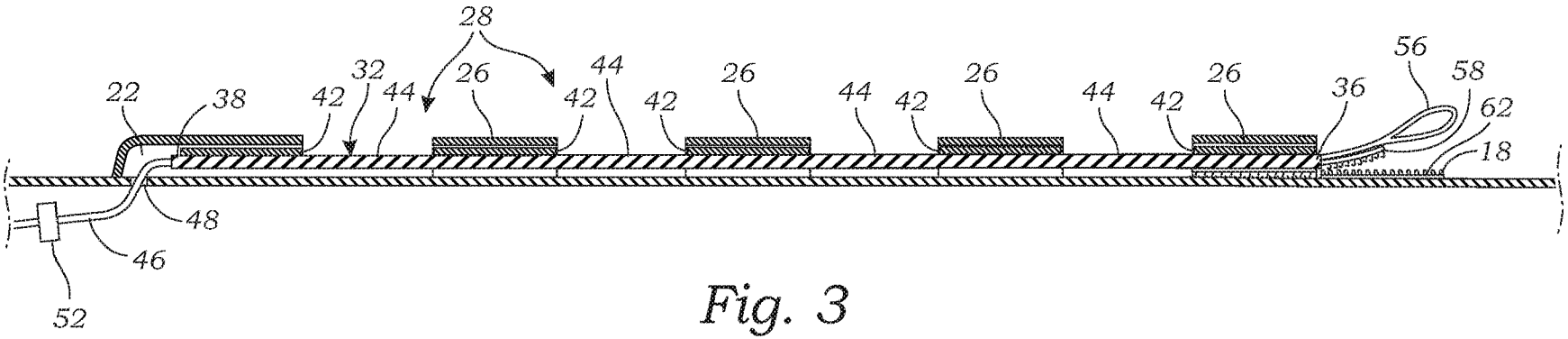
FIG. 3 is a side cross-sectional view of the reflector system in the non-reflective configuration of FIG. 1.
Figure 4:
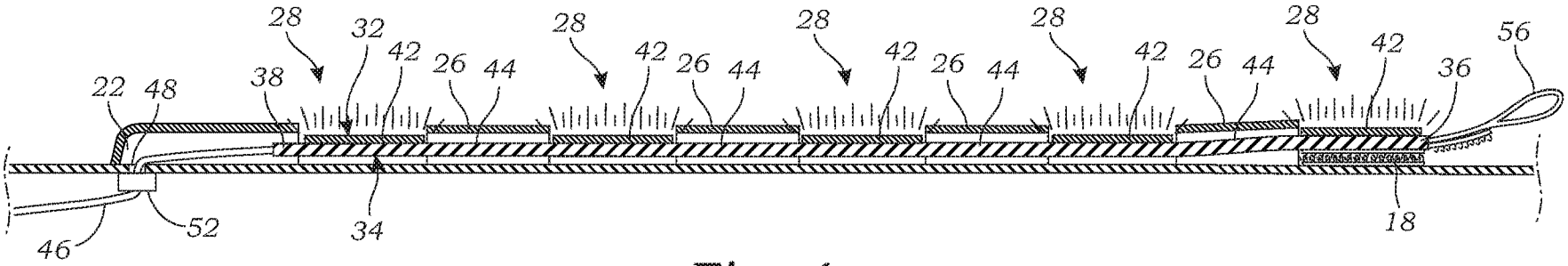
FIG. 4 is a side cross-sectional view of the reflector system in the reflective configuration of FIG. 2.

FIG. 1 is a perspective view of a jacket 12 that includes a reflector system 10 according to one embodiment of the present invention, illustrating the reflector system 10 in a non-reflective configuration. FIG. 2 is a close up perspective view of the reflector system 10, illustrating the reflector system 10 once it has been moved to a reflective configuration. FIG. 3 is a side cross-sectional view of the reflector system 10 in the non-reflective configuration of FIG. 1. FIG. 4 is a side cross-sectional view of the reflector system 10 in the reflective configuration of FIG. 2.

As shown in FIGS. 1-4, the reflector system 10 includes a channel 14 and a strap 16. The channel 14 is adjacent, formed on, or defined in the article of clothing, in this embodiment the jacket 12. For purposes of this application, the term "jacket" is defined to include any form of clothing worn over a person's midsection, including uniform jackets, work jackets, vests, and similar forms of clothing.

As shown in FIGS. 1-4, the strap 16 is shaped and sized to fit into and slidably engage the channel 14, so that the strap 16 may slide longitudinally within the channel 14. In this embodiment, the channel 14 is formed by side edges 24 that extend between a proximal end 18 and a distal end 22 of the channel 14. The channel 14 may include and be formed by at least one cover band 26, in this case a plurality of cover bands 26, that extend across the channel 14, and over the strap 16, so that the strap 16 slides within the channel 14 and beneath the plurality of cover bands 26. The plurality of cover bands 26 are longitudinally spaced from each other and from the proximal end 18 and the distal end 22 to form a plurality of open windows 28 therebetween, so that portions of the strap 16 are covered by the plurality of cover bands 26, and other portions of the strap 16 are left uncovered.

The strap 16 includes a front surface 32 and an opposed rear surface 34 that extend between a first end 36 and a second end 38. The front surface 32 includes a plurality of reflective sections 42 that are spaced apart from one another by the plurality of non-reflective sections 44. The plurality of reflective sections 42 may include reflective tape, although alternatively may include any form of reflective paint, dye, material, attachment, or equivalent material that makes the material highly reflective. The term "reflective" is defined to mean meeting applicable government standards for reflectivity of safety garments. According to the Technical Data Sheet Specifications, this product has a light reflectivity or brightness rating on the order of 500 candlepower lumens (CPL), although equivalent materials may also be used, as long as they would be deemed to be suitable by one skilled in the art. The reflective material may be, for example, a light reflective material known as SCOTCHLITE™, manufactured by the 3M Company.

Adjacent and parallel reflective sections 42 may be used so that in a first position, shown in FIGS. 1 and 3, the plurality of reflective sections 42 are hidden behind the plurality of cover bands 26, and only the plurality of non-reflective sections 44 may be seen. The plurality of non-reflective sections 44 may be camouflaged to match the rest of the jacket 12, or otherwise constructed of a dark and/or otherwise low-visibility material.

As shown in FIGS. 2 and 4, the strap 16 has been moved longitudinally (e.g., by pulling one end of the strap 16) a distance so that the reflective portions are visible, while the non-reflective portions are not visible, behind the plurality of cover bands 26.

Figure 5:
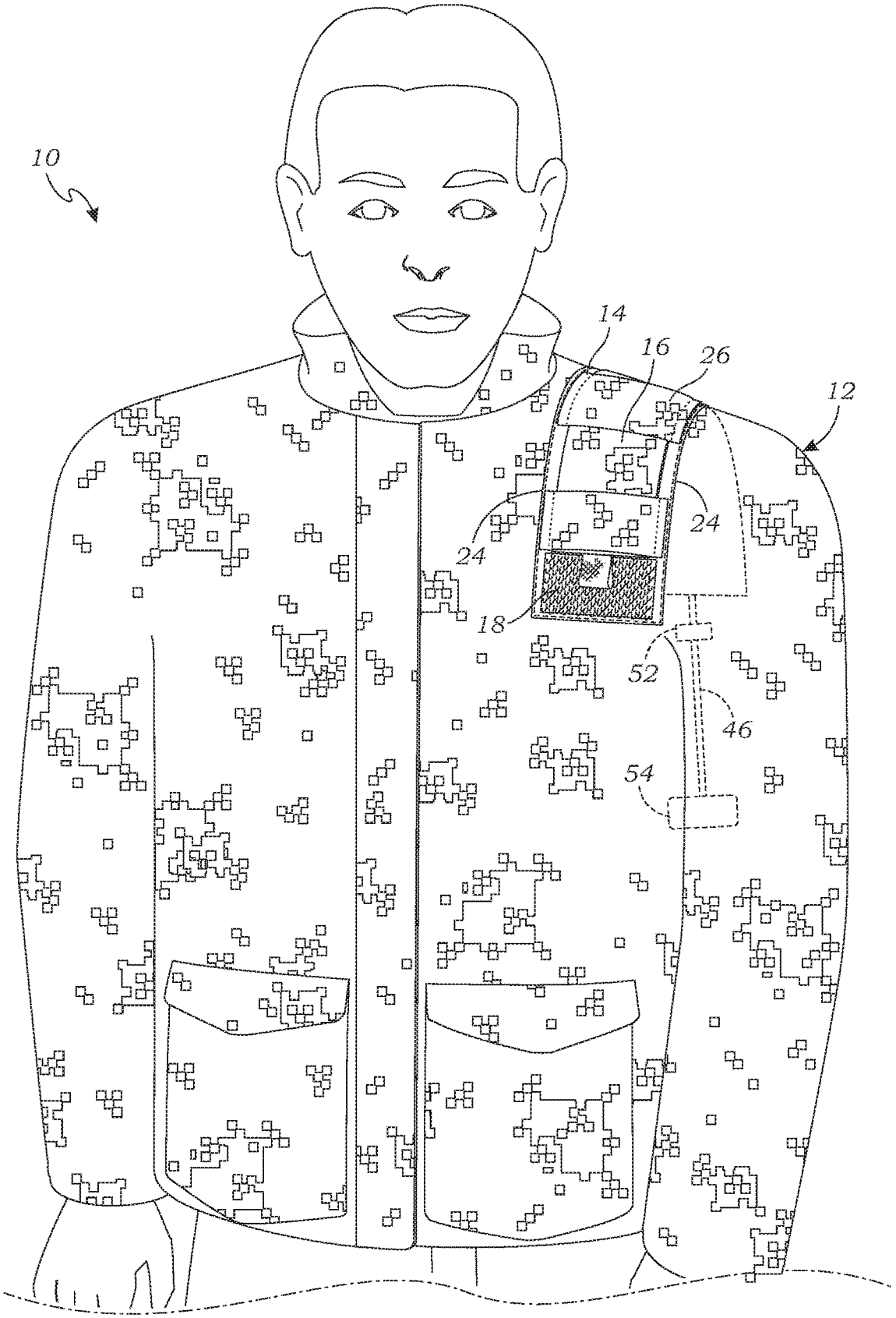
FIG. 5 is a rear perspective view of the jacket.

FIG. 5 is a rear perspective view of the jacket 12 of FIG. 1, showing the function of a pull-cord 46 that adjusts the positioning of the strap 16 within the channel 14. As shown in FIG. 3-4, the pull-cord 46 feeds through an aperture 48 at the proximal end 18 of the channel 14, where it rests inside the jacket 12. FIGS. 3-5 show a stopping-mechanism 52 attached to the pull-cord 46, thereby preventing the cord from feeding all the way through the aperture 48 when the strap 16 is pulled. At the untethered end of the pull-cord 46 is a handle 54, so that the strap 16 may be easily adjusted within the channel 14 to show either the reflective 42 or non-reflective sections 44.

While the reflector system 10 is shown as an integral part of the clothing or other item, in alternative embodiments, this is not required. For example, the reflector system 10 may be attachable/removable from the clothing, such as via hooks and loops (Velcro®) fasteners, or other forms of fasteners, or in any other manner known in the art. Furthermore, the reflector system 10 does not need to be constructed of fabric, but may be constructed of any suitable material that is selected by one skilled in the art (e.g., polyethylene, or any other suitable material known in the art). In one embodiment, the reflector system 10 is constructed of, or incorporates, Teflon® or other similar material, to facilitate the sliding motion of the reflector system 10.

As shown in FIGS. 1-5, the first end of the strap 16 may include a pull-tab 56 to facilitate pulling the strap 16 from the first position to the second position. The strap 16, and/or other portions of the first end 36, may include a first fastener 58 that removably engages a second fastener 62 (e.g., hooks and loops, snaps, etc.) of the jacket 12 (or other article of clothing used) for fastening the strap 16 in the selected configuration. In another embodiment, the strap 16 may not include such a pull-tab 56, and the reflector system 10 may be adjusted using alternative features and methods.

While one embodiment of the invention utilizes reflective and non-reflective surfaces, as described above, in another embodiment, other exterior surfaces may also be used. In one embodiment, first surface sections may be of one color, and second surface sections may be another color, usually a contrasting color, so that the system may be adjusted to expose one of the two alternative colors. In another embodiment, the first and second surface sections may have distinguishing textures and/or colors, or them may include various forms of indicia (e.g., corporate logos or other forms of trademarks, decorative features, etc.).

In yet another embodiment, the first and second surface sections may include different forms of materials, for example, with one being a solid sheet of material, while the other has apertures (e.g., is vented, etc.). Those skilled in the art may devise many alternative constructions consistent with the teachings of the present invention, and these alternatives should be considered within the scope of the present invention.

In another embodiment, the reflector system 10 may further include a biasing mechanism (not shown) to bias the strap 16 towards a given position (e.g., an elastic strap, or any other form of spring, or similar element known in the art), that is attached to the strap to bias the strap 16 towards one of the configurations.

As used in this application, the words "a," "an," and "one" are defined to include one or more of the referenced item unless specifically stated otherwise. The terms "approximately" and "about" are defined to mean+/−10%, unless otherwise stated. Also, the terms "have," "include," "contain," and similar terms are defined to mean "comprising" unless specifically stated otherwise. Furthermore, the terminology used in the specification provided above is hereby defined to include similar and/or equivalent terms, and/or alternative embodiments that would be considered obvious to one skilled in the art given the teachings of the present patent application. While the invention has been described with reference to at least one particular embodiment, it is to be clearly understood that the invention is not limited to these embodiments, but rather the scope of the invention is defined only by claims to the subject invention.

What is claimed is:

1. A reflector system for use in an article of clothing, the reflector system comprising:

a channel formed adjacent the article of clothing, the channel having side edges that extend between a proximal end and a distal end;

a strap having a first end and a second end, the strap being shaped and sized to fit into and slidably engage the channel, so that the strap may slide longitudinally within the channel between the proximal end and the distal end;

a plurality of cover bands that extend across the channel, and over the strap, so that the strap slides within the channel and beneath the plurality of cover bands, the plurality of cover bands being longitudinally spaced from each other and from the proximal end and the distal end of the channel to form a plurality of open windows therebetween;

the strap including a front surface that includes a plurality of reflective sections that are spaced apart from one another by a non-reflective sections; and wherein when the strap is in a first position, each of the plurality of cover bands covers one of the reflective sections, and when the strap is in a second position, the reflective sections are each within one of the open windows between the cover bands, and thereby positioned to reflect light incident thereupon.

2. The reflector system of claim 1, further comprising a pull-tab attached to the first end of the strap to facilitate pulling the strap from the first position to the second position.

3. The reflector system of claim 1, further comprising first and second fasteners for securing the strap in the second position.

4. The reflector system of claim 3, wherein the first fastener is attached to the first end of the strap, and the second fastener is attached to the proximal end of the channel.

5. The reflector system of claim 4, wherein the first and second fasteners are hooks and loops fasteners.

6. A reflective garment adapted to be worn by a person, the reflective garment comprising:

a jacket;

a channel formed in the jacket, the channel having side edges that extend between a proximal end and a distal end;

a strap having a first end and a second end, the strap being shaped and sized to fit into and slidably engage the channel, so that the strap may slide longitudinally within the channel between the proximal end and the distal end;

a plurality of cover bands that extend across the channel, and over the strap, so that the strap slides within the channel and beneath the plurality of cover bands, the plurality of cover bands being longitudinally spaced from each other and from the proximal end and the distal end of the channel to form a plurality of open windows therebetween;

the strap including a front surface that includes a plurality of reflective sections that are spaced apart from one another by a non-reflective sections; and wherein when the strap is in a first position, each of the plurality of cover bands covers one of the reflective sections, and when the strap is in a second position, the reflective sections are each within one of the open windows between the cover bands, and thereby positioned to reflect light incident thereupon.

7. The reflector system of claim 6, further comprising a pull-tab attached to the first end of the strap to facilitate pulling the strap from the first position to the second position.

8. The reflector system of claim 6, further comprising first and second fasteners for securing the strap in the second position.

9. The reflector system of claim 8, wherein the first fastener is attached to the first end of the strap, and the second fastener is attached to the proximal end of the channel.

10. The reflector system of claim 9, wherein the first and second fasteners are hooks and loops fasteners.

* * * * *